US008899826B2

(12) United States Patent
Pilz

(10) Patent No.: US 8,899,826 B2
(45) Date of Patent: Dec. 2, 2014

(54) ENCASED TIMEPIECE

(76) Inventor: Olaf Pilz, Allershausen (DE)

( * ) Notice: Subject to any disclaimer, the term of this patent is extended or adjusted under 35 U.S.C. 154(b) by 569 days.

(21) Appl. No.: 13/228,264

(22) Filed: Sep. 8, 2011

(65) Prior Publication Data

US 2012/0069718 A1 Mar. 22, 2012

(30) Foreign Application Priority Data

Sep. 21, 2010 (DE) ..... 20 2010 013 476 U

(51) Int. Cl.
*G04B 37/14* (2006.01)
*G04B 45/00* (2006.01)

(52) U.S. Cl.
CPC ..... *G04B 37/1413* (2013.01); *G04B 37/1406* (2013.01); *G04B 45/0069* (2013.01)
USPC ..... 368/276; 368/278; 368/281; 368/283; 206/18; D10/6; D10/33

(58) Field of Classification Search
CPC ..... G04B 37/1413; G04B 37/1406; G04B 45/0069
USPC ..... 368/88, 276–278, 281, 283–285, 299, 368/300, 301, 10, 316; D10/6, 33; 206/18, 206/301
See application file for complete search history.

(56) References Cited

U.S. PATENT DOCUMENTS 365,986 A * 7/1887 Giles ..... 368/276
410,945 A * 9/1889 Taft ..... 368/298
634,919 A * 10/1899 Steinmeyer ..... 368/312
963,461 A * 7/1910 Moosmann ..... 224/241
1,139,187 A * 5/1915 Kaak ..... 368/286
1,991,284 A * 2/1935 Lewbel ..... 368/277
2,116,493 A 5/1938 Wachter
2,154,225 A 4/1939 Wewetzer
2,182,194 A * 12/1939 Blau ..... 368/277
4,627,738 A * 12/1986 Kao ..... 368/281
4,660,992 A 4/1987 Paul et al.
4,796,240 A * 1/1989 Stevens ..... 368/281
5,018,118 A 5/1991 Ross
5,168,479 A 12/1992 Lima
5,283,769 A 2/1994 Renton
5,375,102 A 12/1994 Schiavolini
5,392,261 A * 2/1995 Hsu ..... 368/281
5,502,690 A 3/1996 Wohlfahrt (Continued)

FOREIGN PATENT DOCUMENTS

CN 201184961 Y 1/2009
JP 6214051 A 8/1994
WO 9749008 12/1997

*Primary Examiner* — Vit W Miska
(74) *Attorney, Agent, or Firm* — The IP Law Firm of Guy Levi, LLC; Guy Levi

(57) ABSTRACT

According to an embodiment of the invention a timepiece is provided, having a body, a case at least partially imitating a tin can. The body is configured to be inserted into the case and assuming an assembled position and a mounting mechanism adapted to releasably secure the body to the case in the assembled position.

According to another embodiment of the invention a timepiece is provided, having a body, a replaceable timepiece face, and a case at least partially imitating a tin can. The body is configured to be inserted into the case and assuming an assembled position and the timepiece face is configured to be releasably coupled to the body.

17 Claims, 4 Drawing Sheets

(56) References Cited

U.S. PATENT DOCUMENTS

| | | | | | |
|---|---|---|---|---|---|
| 5,646,913 | A | | 7/1997 | Quesenberry | |
| D397,041 | S | * | 8/1998 | Abels | D10/6 |
| D408,746 | S | * | 4/1999 | Jorss | D10/33 |
| 6,002,651 | A | * | 12/1999 | Baccaray | 368/10 |
| 6,079,872 | A | | 6/2000 | Besson | |
| 6,278,664 | B1 | | 8/2001 | Huffman et al. | |
| 6,464,389 | B1 | * | 10/2002 | Ghoorahoo | 368/278 |
| 6,681,953 | B2 | | 1/2004 | Au | |
| 6,819,632 | B1 | * | 11/2004 | Paul | 368/88 |
| 7,126,881 | B2 | | 10/2006 | Cooper et al. | |
| 7,177,234 | B1 | | 2/2007 | Paul | |
| 7,333,399 | B2 | * | 2/2008 | Ellner et al. | 368/88 |
| 8,292,493 | B2 | * | 10/2012 | Mooring | 368/276 |

* cited by examiner

ENCASED TIMEPIECE

CROSS REFERENCE TO RELATED APPLICATIONS

This application claims priority to German Patent Application No. DE202010013476.5 filed on Sep. 21, 2010 the content of which is incorporated herein by reference in its entirety.

TECHNICAL FIELD

The present invention generally relates to, but is not limited to timepieces and more specifically the present invention relates to, but is not limited to a timepiece body and case whereby the case partly replicates a tin/can.

BACKGROUND

Various timepieces are known. A timepiece or a watch can be used for both time determination and for decorative purposes.

It is appreciated that it would be desirable to enable a change in various timepiece appearances.

Several solutions have been disclosed in the art. Examples of such solutions are described in more detail in the following patents: U.S. Pat. No. 5,018,118; U.S. Pat. No. 7,177,234; WO9749008; U.S. Pat. No. 6,278,664; JP06214051; U.S. Pat. No. 4,660,992; U.S. Pat. No. 5,168,479; U.S. Pat. No. 5,375,102; CN201184961; U.S. Pat. No. 5,502,690; U.S. Pat. No. 2,154,225; U.S. Pat. No. 7,126,881; U.S. Pat. No. 6,079,872; U.S. Pat. No. 5,646,913; U.S. Pat. No. 2,116,493; U.S. Pat. No. 5,283,769; U.S. Pat. No. 6,681,953.

SUMMARY

According to a first broad aspect of the present invention, there is provided a timepiece, comprising a body and a case at least partially imitating a tin can. The body is configured to be inserted into the case and assuming an assembled position and a mounting mechanism adapted to releasably secure the body to the case in the assembled position. According to a second broad aspect of the present invention, there is provided a timepiece, comprising a body, a replaceable timepiece face, and a case at least partially imitating a tin can. The body is configured to be inserted into the case and assuming an assembled position and the timepiece face is configured to be releasably coupled to the body.

According to a third broad aspect of the present invention, there is provided a timepiece, comprising a body, a case at least partially imitating a tin can. The body is configured to be inserted into the case and assuming an assembled position and a mounting element coupled to the case and adapted for attaching a securement element.

These and other aspects and features of non-limiting embodiments of the present invention will now become apparent to those skilled in the art upon review of the following description of specific non-limiting embodiments of the invention in conjunction with the accompanying drawings.

BRIEF DESCRIPTION OF THE DRAWINGS

A better understanding of the non-limiting embodiments of the present invention (including alternatives and/or variations thereof) may be obtained with reference to the detailed description of the non-limiting embodiments along with the following drawings, in which.

DESCRIPTION OF THE NON-LIMITING EMBODIMENTS

Figure 1:
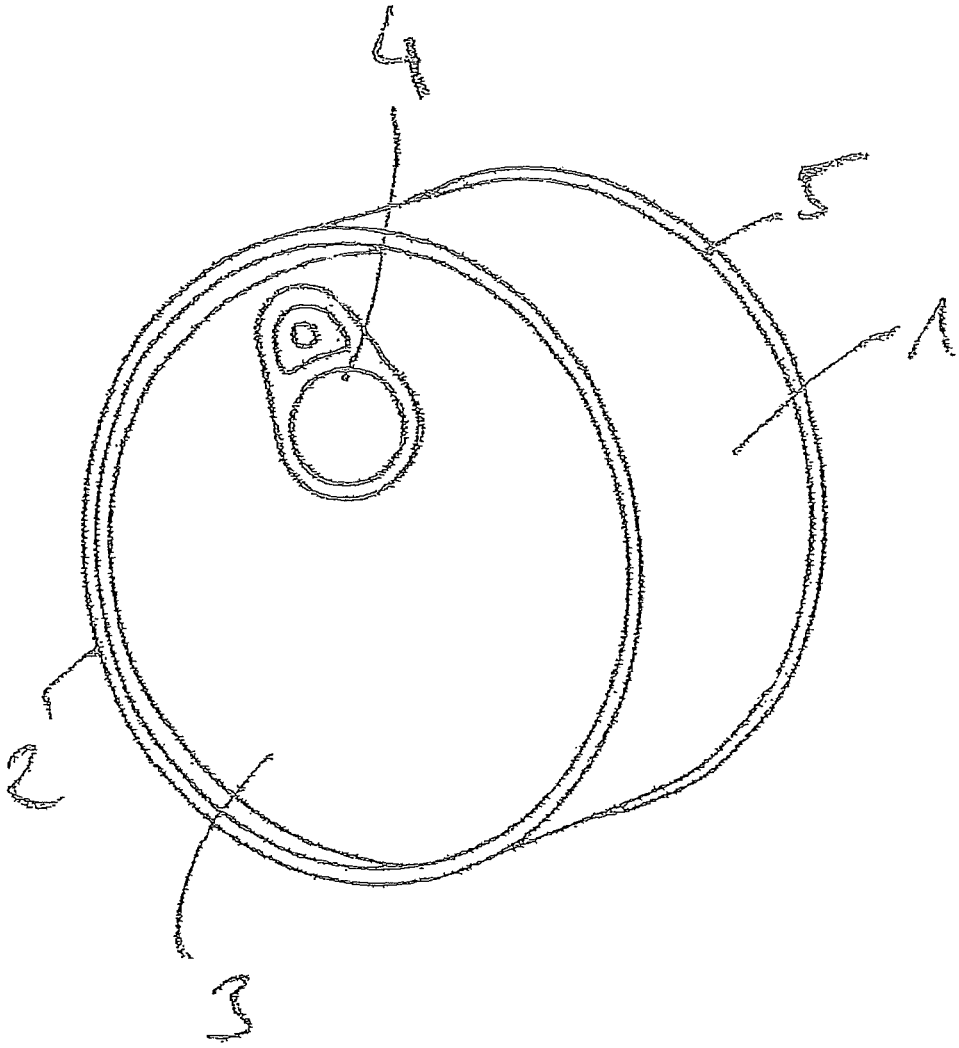
FIG. 1 is a simplified perspective view of a timepiece body with a case implemented in accordance with a non-limiting embodiment of the present invention; the timepiece is being depicted in the assembled state.

Reference is now made to FIG. 1, which depicts a simplified perspective view of a timepiece body with a case implemented in accordance with a non-limiting embodiment of the present invention. The timepiece is being depicted in the assembled state.

According to embodiments of the present invention, the timepiece comprises a timepiece body 8 and the case.

It is appreciated that the case which replicates a can provides good protection for the timepiece body 8.

The case is preferably formed of a generally annular member 1. The case of the specified timepiece can be made of a tin plate, laminated cardboard, metal or any other material that has the appearance of a commercially available generally cylindrical can. The annular member 1 of the case preferably has two opposed edges, a knurl 2 and a rearward edge 5. A pull off lid 3 may be disposed adjacent the knurl 2 and the annular member 1 preferably connects the knurl 2 and the rearward edge 5.

The lid 3 may be made of metal and designed with a pull of ring 4. The lid 3 is preferably joined to the case by the knurl 2 and the annular member 1. The annular member 1 may be made of metal or of cardboard or plastic or may be alternatively laminated cardboard. Reduced production costs can be achieved if the outer covering of the case annular member 1 is manufactured out of cardboard material, particularly laminated cardboard.

Figure 2:
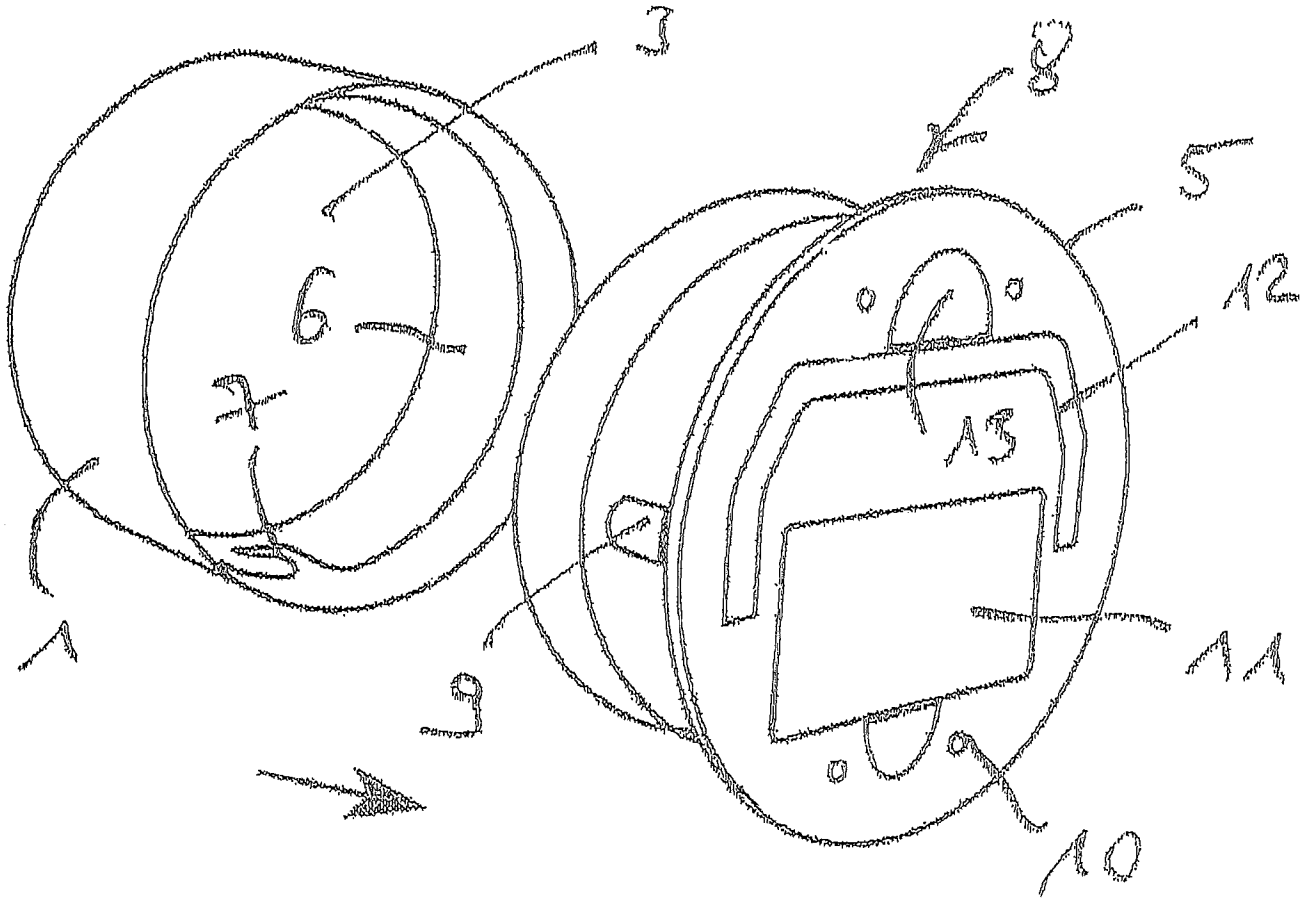
FIG. 2 is a simplified rear exploded view of the timepiece body with the case, as shown in FIG. 1.

Reference is now made to FIG. 2, which depicts a simplified rear exploded view of the timepiece body with the case, as shown in FIG. 1.

Within the implementation of FIG. 2, the rear perspective view of the case with the timepiece body 8 is shown. A mounting mechanism 6 can be seen inside the case. The mounting mechanism 6 according to one embodiment of the invention may be shaped as an inward ring, forming a mounting recess 7.

It can further be seen in FIG. 2 that the timepiece body 8 that is encircled by the annular member 1 may bear a corresponding mounting protuberance 9, which can be latched into the mounting recess 7 and form a bayonet connection.

It is appreciated that any mounting mechanism known in the art that would permit the disengagement of the annular member 1 from the rearward edge 5 and the timepiece body 8 can be alternatively utilized, such as but not limited to a snap, a clamping mechanism, a screw type fixation, friction fit or any other fastener that can allow a removable engagement of the annular member 1 along with the lid 3 from the rearward edge 5 and the timepiece body 8.

The mounting mechanism 6 may be positioned on the inner surface of the annular member 1 or the outer surface of the timepiece body 8, thus the mounting mechanism is protected against external damage.

A conventional timepiece mechanism can be accommodated in the timepiece body 8, such that a timepiece face (not shown) is adapted to face the pull off lid 3. The opposite side of the timepiece body 8 has mounting elements, for example in a form of magnets 10 to be attached to a metal surface or attachment member, such as clamp attachment, hole, recess, U-shape bar or any other fastener that enables holding of a securement element of a preferably elongated shape, such as a chain or a bracelet. The opposite side of the timepiece body 8 may also have attachment hooks, recesses 13 or alternatively foldout foot 12.

FIG. 2 further shows a detachable cover for a battery compartment 11.

Figure 3:
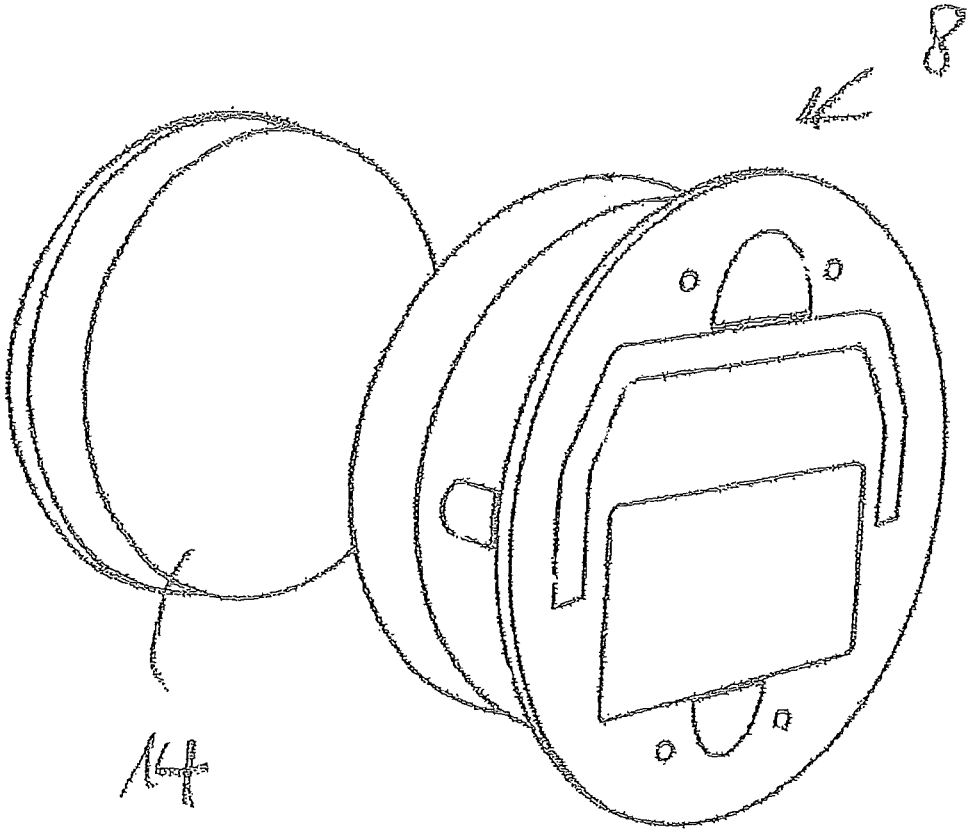
FIG. 3 is a simplified rear exploded view of the covering and the timepiece body, as shown in FIG. 1.

Reference is now made to FIG. 3, which depicts a simplified rear exploded view of the covering and the timepiece body, as shown in FIG. 1.

Within the implementation of FIG. 3, a preferably transparent cover 14 is shown as covering the timepiece face of the timepiece body 8, which is opposed to the pull off lid 3. The cover 14 is of a preferably circular shape, corresponding to the shape of the case and having a radially externally extending annular rim on its outer circumference.

Figure 4:
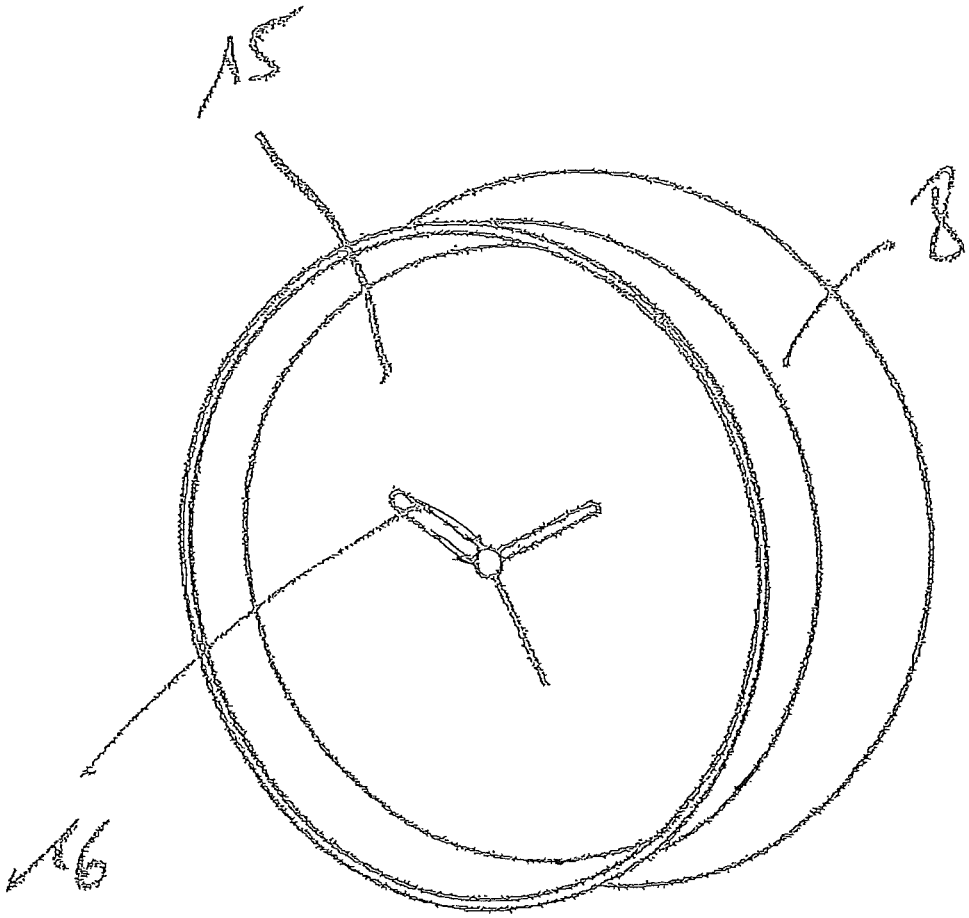
FIG. 4 is a simplified front perspective view of the timepiece body, as shown in FIG. 1.

Reference is now made to FIG. 4, which depicts a simplified front perspective view of the timepiece body, as shown in FIG. 1.

Within the implementation of FIG. 4, a frontal view of the timepiece body can be seen. The timepiece face 15 acts as a display member and hands 16 are shown as mounted on the timepiece face 15.

The hands 16 are preferably made detachable in order to allow exchanging the panel of the timepiece face 15.

The hands 16 of the timepiece may be protected by a transparent covering 14 placed between the knurl 2 and the timepiece face 15, whereby the timepiece face 15 is preferably exchangeable and clamped between the transparent covering 14 and the timepiece body 8.

The timepiece may be assembled by way of placing the cover 14 onto the timepiece face 15 of the timepiece body 8, such that the rim of the cover 14 fastens the timepiece face 15 and the timepiece body 8 together and subsequently, the timepiece body 8 and the cover 14 are coupled together. The pull of lid 3 may be positioned adjacent the cover 14 and the mounting recess 7 of the mounting mechanism 6 may be placed into the corresponding mounting protuberance 9, such that the case is preferably positioned adjacent the rearward edge 5 in the assembled position.

It is appreciated that a pull off lid 3 may prevent damage during transport and protect the timepiece face 15.

In accordance to the embodiments of the invention, the timepiece may be opened by tearing off the pull off lid 3 and assume an unassembled position, whereby, the timepiece face 15 can be replaced upon.

It is appreciated that the timepiece face 15 may be opened using the mounting mechanism 6, by displacing the mounting recess 7 from the mounting protuberance 9 and assuming an uncovered position, thus the pull off lid 3 stays unharmed. The cover 14 in the uncovered position may be removed, thus allowing to change the timepiece face 15 to any desired format.

It is also appreciated that the case with the timepiece body 8 may have a mounting element on the outer circumference of the timepiece body 8 or on the opposite side of the timepiece body 8, which can be coupled to a securement element of a generally elongated shape, such as a chain, a band or any other member configured to hold the timepiece. As previously mentioned, the mounting element may comprise of magnets 10, recess 13, fold out foot 12, any other recesses or several of the abovementioned elements together.

An example of such securement element may be a band adapted to be worn over the wrist of a user and hold the timepiece with the case thereon.

Another example of such securement element may be a chain, the timepiece with the case can be held on a chain.

Description of the non-limiting embodiments of the present inventions provides examples of the present invention, and these examples do not limit the scope of the present invention. It is to be expressly understood that the scope of the present invention is limited by the claims. The concepts described above may be adapted for specific conditions and/or functions, and may be further extended to a variety of other applications that are within the scope of the present invention. Having thus described the non-limiting embodiments of the present invention, it will be apparent that modifications and enhancements are possible without departing from the concepts as described. Therefore, what is to be protected by way of letters patent are limited only by the scope of the following claims:

What we claim is:

1. A timepiece, comprising:

a body;

a case at least partially imitating a tin can, said case having a pull off lid and a pull off ring attached thereto;

the body configured to be inserted into the case employing a mounting mechanism to assume an assembled position;

the mounting mechanism configured to reversibly release said body from said case to assume an uncovered position; and said pull off lid configured to be torn off using said pull off ring to irreversibly uncover said body to assume an unassembled position.

2. The timepiece of claim 1, also comprising a timepiece face configured to be coupled to the body.

3. The timepiece of claim 2, and wherein said pull off lid is adapted to cover the timepiece face.

4. The timepiece of claim 2, wherein the timepiece face is configured to be replaceable when in either of said unassembled and said uncovered position.

5. The timepiece of claim 1, wherein the mounting mechanism has a connector functionality of magnetic type.

6. The timepiece of claim 3, also comprising a covering adapted to be located between the timepiece face and the pull off lid.

7. The timepiece of claim 1, wherein the case has an annular member adapted to encircle the body within.

8. The timepiece of claim 7, wherein the annular member is formed of cardboard.

9. A timepiece, comprising:

a body;

a replaceable timepiece face;

a case at least partially imitating a tin can, said case having a pull off lid and a pull off ring attached thereto;

the body is configured to be inserted into the case and to assume an assembled position and a mounting mechanism configured to reversibly release said body from said case to assume an uncovered position;

and wherein the timepiece face is configured to be releasably coupled to the body.

10. The timepiece of claim 9, wherein said mounting mechanism has a connector functionality of magnetic type.

11. A timepiece, comprising:

a body;

a replaceable timepiece face, which is configured to be releasably coupled to the body;

a case at least partially imitating a tin can, having a pull off lid and a pull off ring attached thereto;

the body is configured to be inserted into the case and to assume an assembled position and a mounting mechanism configured to reversibly release said body from said case to assume an uncovered position, thereby allowing replacement of said timepiece face;

and wherein said timepiece face can be replaced without manipulation of said pull off lid.

12. The timepiece of claim 11, and wherein said pull off lid is configured to be torn off using said pull off ring to irreversibly uncover said body to assume an unassembled position, thereby allowing replacement of said timepiece face.

13. The timepiece of claim 11, wherein said mounting mechanism has a connector functionality of magnetic type.

14. The timepiece of claim 9, and wherein said pull off lid is adapted to cover the timepiece face.

15. The timepiece of claim 9, and wherein the pull off lid is adapted to be at least partially torn off using said pull off ring to reversibly uncover said body to assume an unassembled position.

16. The timepiece of claim 9, wherein the timepiece face is configured to be replaceable when in the unassembled position.

17. The timepiece of claim 9, also comprising a covering adapted to be located between the timepiece face and the pull off lid.

* * * * *